United States Patent [19]

Meyers

[11] 3,958,340

[45] May 25, 1976

[54] METHOD AND APPARATUS FOR DRYING WIGS

[76] Inventor: Jess Edward Meyers, 1013 Silver Lake Drive, Las Vegas, Nev. 89108

[22] Filed: May 15, 1975

[21] Appl. No.: 577,894

Related U.S. Application Data

[63] Continuation-in-part of Ser. No. 407,803, Oct. 19, 1973, abandoned.

[52] U.S. Cl. ..... 34/1; 34/3; 34/96; 34/103

[51] Int. Cl.[2] ..... F26B 3/34

[58] Field of Search ..... 34/1, 3, 103, 96; 219/10.55

[56] References Cited

UNITED STATES PATENTS

| | | | |
|---|---|---|---|
| 3,410,116 | 11/1968 | Levinson | 68/3 |
| 3,434,220 | 3/1969 | Forster | 34/1 |
| 3,451,401 | 6/1969 | Levinson | 68/3 |
| 3,470,942 | 10/1969 | Fukada et al. | 219/10.55 |
| 3,501,847 | 3/1970 | Sanford et al. | 34/103 |
| 3,605,272 | 9/1971 | Boocher | 34/1 |
| 3,611,582 | 10/1971 | Hamid et al. | 34/1 |
| 3,721,013 | 3/1973 | Miller | 34/1 |
| 3,744,147 | 7/1973 | Pless | 34/1 |

FOREIGN PATENTS OR APPLICATIONS

| | | | |
|---|---|---|---|
| 1,175,940 | 10/1968 | United Kingdom | 34/103 |

*Primary Examiner*—Charles J. Myhre
*Assistant Examiner*—Paul Devinsky
*Attorney, Agent, or Firm*—Edward J. Quirk

[57] ABSTRACT

An improved method for rapidly drying wigs comprises circulating air through the wig material in the presence of microwave heating. The microwave source is cycled with a cycle time of from about ½ second to 15 seconds on, followed by an interval of about ½ to 30 seconds off. An apparatus for practicing this technique comprises a microwave oven adapted with means for forced circulation of air, optionally heated, through the wig, and means for exhausting circulated air from the oven.

5 Claims, 3 Drawing Figures

METHOD AND APPARATUS FOR DRYING WIGS

CROSS REFERENCES TO RELATED APPLICATION

This application is a continuation in part of application Ser. No. 407,803, filed Oct. 19, 1973, now abandoned.

BACKGROUND OF THE INVENTION

This invention relates to a rapid method for drying wigs, and apparatus therefor.

It has become common practice for women to wear hairpieces, generally known as "wigs", for reasons of style and convenience. Wigs are fabricated by fastening hair-like strands, which may be real human or animal hair or a synthetic fiber such as nylon, acrylic, modacrylic, polyester or other polymer, to net-like base. The base commonly contains an elastic material around the circumference of the base to help hold the wig in place on the wearer's head.

A major convenience to a wig owner is the fact that a wig can be washed, styled, and dried while it is not being worn. It is common for women to bring their wigs to commercial establishments, e.g., beauty parlors, to have their wigs washed and set. However, a major inconvenience with washing a hairpiece is the amount of time necessary to completely dry the hairpiece such that it may be worn. Depending on the moisture-retention properties of the wig, drying time in ambient conditions can be up to several days. Even under conventional hair dryers, drying time may be as long as 4–6 hours. In commercial beauty parlors, the use of hair dryers to dry wigs removes these dryers from their normal use in servicing customers. Even commercial units sold specifically for drying wigs require very long wig residence times. Sustained periods of exposure of a hairpiece to high temperatures can shorten its useful life, causing the fibers to become dry and crack, and also causing deterioration and loss of elasticity of the rubber.

It is well known to dry wigs by passing heated air through the wig fibers, such as under a conventional hood-type hair dryer. It is also known to dry wigs in an enclosed ovenlike structure.

It is also known to use microwave energy to remove moisture from certain articles. For example, U.S. Pat. No. 3,721,013, issued Mar. 20, 1973 to Donald G. Miller, describes a method of drying wood with microwaves while circulating heated air throughout the wood kiln. However, the problems associated with drying wigs in the presence of microwaves have not been recognized in the art.

SUMMARY OF THE INVENTION

It has now been discovered that wigs can be dried safely and rapidly under carefully controlled conditions in a microwave oven which has been adpated with means for circulating air through the wig while the oven is in operation. Air is drawn from outside of the oven, and forced through a duct system to a vertically mounted wig support structure. The support structure, over which the wig is stretched, contains perforations which direct the air through the wig base and fibers. The air passes through the wig from inside to outside, and into the body of the oven, and is exhausted through vents in the oven.

DESCRIPTION OF PREFERRED EMBODIMENT

Figure 1:
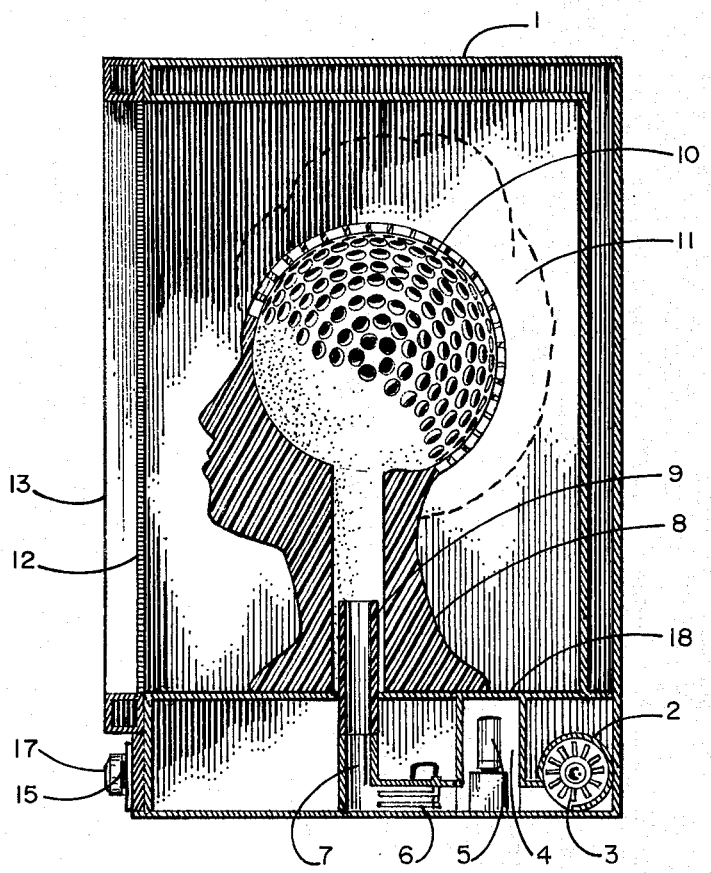
FIG. 1 shows a cutaway side view of a microwave oven containing a wig supported for drying.

The invention may be more clearly understood by reference to the drawings, which illustrate a specific embodiment of the invention. FIG. 1 shows microwave oven 1 equipped with features of the invention. Air flow throughout the system is created by blower 3, which draws air through air intake 2, and forces the air through the magnetron container 4 where the magnetron 5 is cooled by the air, then through heating element 6 where the air may be heated if desired, and into ducting system 7. Air passes through the ducting system into wig support structure 8, which is removably mounted to the ducting system exhaust 9. The ducting system exhaust is preferably a vertical piece of plastic pipe which fits into the downstream end of the ducting system; plastic is transparent to microwave radiation and will not interfere with the transmission of waves throughout the oven. Air flows through perforations 10 in the top of the wig support structure, through the wig 11, and into the oven. Air is exhausted from the oven through small holes 12 in the oven door 13. Switch 15 on the front of the oven turns the oven on and off, and switch 17 is a cycling control discussed below.

Figure 2:
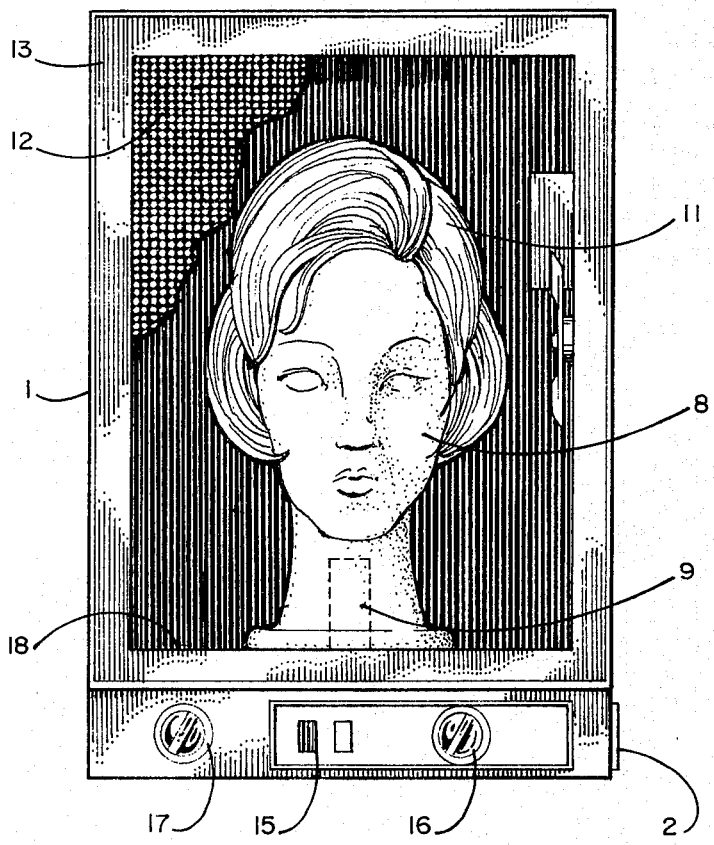
FIG. 2 is a front view of the oven containing a wig supported for drying.

FIG. 2 is a front view of the oven showing power on/off switch 15, timer 16, and cycling control switch 17. The oven timer is a standard control mechanism, which may be mechanical but is typically electrical, for maintaining the power to the oven on for a length of time selected by the user. The cycling device may be a solid state electronic device or a simple mechanical gear and cam mechanism which alternately connects and disconnects the power source. The cycle timer may be preset at fixed cycle intervals, e.g., 10 seconds on, 15 seconds off, or may be adjustable to various cycle times.

Figure 3:
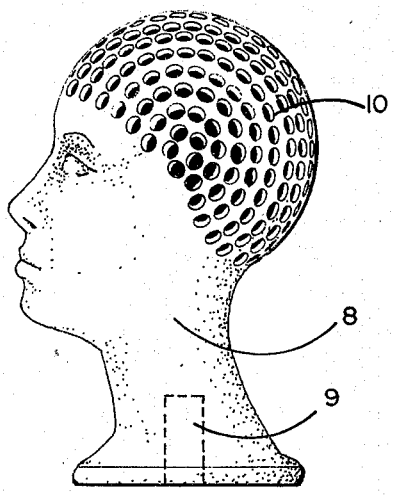
FIG. 3 shows a detailed view of the wig and wig support structure.

FIG. 3 shows a view of wig support structure 8. The wig support structure is preferably fabricated from a light plastic material, such as styrofoam, and is hollow to permit the passage of air. The wig support is removably mounted on the oven floor 18, with air duct exhaust 8 projecting into the structure. Perforations 9 in the top of the support structure allow the passage of air into the wig body. The perforations should extend downwardly to a level on the support structure below the hairline of the wig in order to avoid the creation of hot spots and possible damage to the wig.

Microwave ovens are well known and widely used, principally for the rapid cooking of foods. Typical commercial models are described in an article by John R. Free entitled "The Facts About Microwave Ovens", in the February, 1973 edition of *Popular Science* magazine. Microwaves are produced in the oven by the magnetron, which generates waves of about 2450 MHz frequency and about 12.2 cm wavelength. In general, the source of microwaves is not critical to the invention; while any wave frequency in the microwave range, e.g., 300–30,000 MHz is operable, frequencies within approximately 10% of the commercially available level of about 2450 MHz are preferred. A detailed description of the principles of operation of the microwave oven appears in a publication of Toshiba Shibaura Electric Co., Ltd, entitled "Toshiba Electronic Oven Service Data, Model ER-721 BT, File No. L12-108".

Careful control of the time and conditions of exposure of the wig to microwaves is essential to avoid burning of the wig base or fibers. For example, continued exposure of a wet wig having modacrylic fibers in the apparatus of the invention having internal volume of 1.1 cubic feet at a power of 650 watts and an air flow of about 15 cubic feet per minute resulted in burning of the wig in about 25 seconds. The flow rate and temperature of air, time of exposure, magnetron power output, along with wig properties such as thickness and wetness of the hair, all contribute to determine optimum operating conditions. Air flow through the wig is essential to avoid local hotspotting and to carry moisture away from the wig; flows of at least 10 cubic feet per minute (cfm) and preferably at least 15 cfm are desirable; flows of 15 to 30 cfm are preferred. The upper limit of the air flow is limited, as a practical matter, only by tendencies of higher flow rates to disturb the hair design of the wig or to upset the stability of the wig on its support. It is important to have air flow directed through all parts of the wig to avoid hotspots and possible localized burning, however. For this reason, it is important that the perforations in the wig support structure extend below the hairline of the wig, as illustrated in FIG. 3. Any conventional type of air blowers, such as an electrically driven fan-type blower, is acceptable.

The air may optionally be preheated prior to passing through the wig. Preheating can be effected by passing the air over the magnetron, thereby accomplishing the additional desirable feature of cooling the magnetron, or by a separate preheater, e.g., of a simple resistance type. The amount of preheat desired depends upon the temperature and moisture content of the incoming air. To justify preheating, it is desirable to raise the temperature of the air by at least about 10°F. In general, it is desirable to preheat the air to at least 85°F, preferably 100°F but preferably no more than about 130°F. As a general rule, preheating the air reduces drying time; increasing the air flow also reduces drying time.

The magnetron is powered from a conventional 120 or 220 volt source through conventional transformer circuitry to provide the necessary magnetron voltage. Magnetron power output is typically about 650 watts, but successful operations have been conducted at 450 watts. Lower power outputs, e.g., 350 watts, and higher levels, e.g., 1000 watts, can be operable, but adjustment must be made in air flow and exposure time to compensate for difference in power level. Increasing power output decreases drying time.

Conditions for operation of the oven must be chosen such that the local temperatures in the wig components do not reach the destruction point, i.e., the melting or fusion point or ignition temperature, of the components. It is preferred to control the local temperatures at least 50°F below the destruction point to maintain a sufficient safety margin. Depending on the air flow, preheat, and power conditions chosen, it may be desirable to operate the magnetron intermittently, e.g., turning the power on and off according to a regular cycle. The most important factor is maintaining the portion of the cycle during which the source is operating sufficiently short such that the wig does not burn. While this length of time depends on several factors, including the air flow and magnetron power, at 560 watts and 15 cfm the "on" portion of the cycle should normally not be longer than about 25 seconds, and is preferably from ½ second to 15 seconds, still more preferably from 1 to 10 seconds; in more humid climates, slightly longer on cycle durations may be used, e.g., 5–15 seconds. Off cycle durations need be sufficient only to keep the wig from overheating; durations of at least ½ second, preferably about 1 second, are adequate. Off cycle durations of more than about 30 seconds are unnecessary and are simply time consuming. At lower power outputs and/or higher air flows, longer on cycle times may be used. Very satisfactory drying operations have been conducted using d cycle of 10 seconds on, 20 seconds off; equally satisfactory results are obtained using a 2 seconds on, 1 second off cycle. In general, it is desurable to maintain total drying time at less than about 20 minutes, preferably less than about 15 minutes. Shorter drying times minimize the time of exposure of the wig to a heated environment, allow the convenience of very short turnaround times for drying, and maximize the output of a single dryer. The following Example illustrates a specific instance of drying a wig in about 8 minutes.

EXAMPLE

A modacrylic wig was placed in a microwave oven modified according to the invention and having the following characteristics:

| | | |
|---|---|---|
| Oven Volume | — | 1.1 cubic feet |
| Magnetron Power | — | 650 watts |
| Air Flow | — | 15 cfm |
| Air Preheat | — | None |
| Oven Cycle Time | — | 10 seconds on, 20 seconds off |

The wig was completely soaked with water prior to insertion in the oven, but was completely dry in about 8 minutes. Estimated normal drying time in the absence of the method and apparatus of the invention, and under ambient conditions, would be several days; estimated drying time in a typical commercial wig dryer would be 3–6 hours.

The timer unit for the magnetron is a standard, commercially available item, which need only interrupt the current to the magnetron accroding to a predetermined interval. An Air-Com "Custom" model, 115 volt, 5 watt timer has been successfully used to cycle durations of less than ½ second; a Litton "Vari-Cook" timer; on oven Model 416.000 is also acceptable. Any magnetron of the type used in conventional microwave ovens may be used with these timers; a Toshiba Tube Model 2M53/E3604 (Tube Type M4545B), for example, has been successfully used for this purpose at cycle times as low as ½ second.

The internal size of the oven is not critical, as long as it is sufficiently large to hold the wig and the wig support structure. This would comfortable require about 0.75 cubic feet, preferably at least about 1 cubic foot of space. Larger models could be manufactured to accomodate two or more wig support structures for multiple wig drying, if desired.

It is of course important to vent the inside of the oven to the atmosphere. Commercial ovens generally are fabricated with openings to the outside, allowing vapors to pass out of the oven, generally through a filter. Many ovens have a mesh cover on the front door, as shown in FIG. 2, item 13 of the drawings; this mesh cover allows gases to pass from the oven while reflecting the microwave, thereby allowing some of the radiation to escape to the outside of the oven. It is essential that any vent in the oven be constructed to comply with safety regulations limiting the radiation density outside of the oven. At present, U.S. Public Health regulations require that the power density of microwave radiation resulting from the operation of an electronic oven not exceed one milliwatt per square centimeter at any point five centimeters or more from the external surface of the oven at the time of manufacture. These levels will not be exceeded if the vent is properly baffled to reflect the waves back into the oven, or if the vent holes are much smaller than the microwave wavelength. Door vent holes on the order of ⅛ inch diameter are quite adequate for a 2450 MHz magnetron.

These and other advantages of the invention described herein will be apparent to those skilled in the art.

I claim:

1. A method of drying a wig comprising passing at least about 10 cubic feet per minute of air through substantially all of the fibers of the wig, and simultaneously subjecting the wig to microwave radiation applied at predetermined intermittent intervals wherein the radiation is applied for a duration of from about ½ second to about 25 seconds, separated by intervals of from about ½ second to 30 seconds during which essentially no microwave radiation is applied.

2. The method of claim 1 wherein the duration wherein microwave radiation is applied is from about 1 second to about 10 seconds.

3. The method of claim 1 wherein the microwave radiation is applied in intervals of about 5 to about 15 seconds, separated by intervals of about 10 to about 30 seconds during which no microwave radiation is applied.

4. The method of claim 1 wherein the air is heated to a temperature at least about 10°F above ambient temperature prior to passing through the wig.

5. The method of claim 1 wherein the microwave radiation is applied at a power level of from about 350 watts to about 1000 watts.

* * * * *